US010706728B2

(12) United States Patent
Onomura et al.

(10) Patent No.: US 10,706,728 B2
(45) Date of Patent: Jul. 7, 2020

(54) OPERATION MANAGEMENT APPARATUS, OPERATION MANAGEMENT METHOD, AND NON-TRANSITORY RECORDING MEDIUM

(71) Applicant: SUBARU CORPORATION, Tokyo (JP)

(72) Inventors: Yoichi Onomura, Tokyo (JP); Akihiro Yamane, Tokyo (JP); Shinei Takahashi, Tokyo (JP); Yu Itabashi, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 292 days.

(21) Appl. No.: 15/836,229

(22) Filed: Dec. 8, 2017

(65) Prior Publication Data

US 2018/0204468 A1 Jul. 19, 2018

(30) Foreign Application Priority Data

Jan. 16, 2017 (JP) ..... 2017-004842

(51) Int. Cl.
*G08G 5/00* (2006.01)

(52) U.S. Cl.
CPC ..... *G08G 5/0043* (2013.01); *G08G 5/0034* (2013.01); *G08G 5/0078* (2013.01); *G08G 5/0091* (2013.01)

(58) Field of Classification Search
CPC .. G08G 5/0034; G08G 5/0043; G08G 5/0078; G08G 5/0091
See application file for complete search history.

(56) References Cited

U.S. PATENT DOCUMENTS

2005/0131631 A1* 6/2005 Nakano ..... G01C 21/3492 701/532
2017/0098176 A1* 4/2017 Hirose ..... G06Q 10/02
2017/0158329 A1* 6/2017 Liu ..... B08B 7/028
2019/0059037 A1* 2/2019 Nakata ..... H04W 64/006

OTHER PUBLICATIONS

JAXA Aeronautics Magazine "Flight Path" No. 6, Sep. 2016, p. 05 (English edition: No. 5/6, Oct. 2016, p. 9).

* cited by examiner

*Primary Examiner* — Robert T Nguyen
(74) *Attorney, Agent, or Firm* — McDermott Will & Emery LLP

(57) ABSTRACT

An operation management apparatus includes a surrounding environment estimating unit, an energy calculator, and a time changer. The surrounding environment estimating unit is configured to estimate a surrounding environment at a returning start time of a movable body. The energy calculator is configured to search, based on the surrounding environment, a returning route along which the movable body performs the returning, to a first position from a second position, that is started at the returning start time, and calculate an energy amount necessary for the returning. The time changer is configured to advance the returning start time by a predetermined time period until the energy amount reaches or falls below a predetermined value. The surrounding environment estimating unit and the energy calculator are configured to respectively perform the estimation of the surrounding environment and the calculation of the energy amount, each time the time changer changes the returning start time.

14 Claims, 6 Drawing Sheets

OPERATION MANAGEMENT APPARATUS, OPERATION MANAGEMENT METHOD, AND NON-TRANSITORY RECORDING MEDIUM

CROSS-REFERENCE TO RELATED APPLICATIONS

The present application claims priority from Japanese Patent Application No. 2017-004842 filed on Jan. 16, 2017, the entire contents of which are hereby incorporated by reference.

BACKGROUND

The technology relates to a technique that manages operation of a plurality of movable bodies.

One example use of a movable body is continuous monitoring by a plurality of movable bodies that perform monitoring in turns, for example, as disclosed in JAXA Institute of Aeronautical Technology, "JAXA Aeronautics Magazine FLIGHT PATH No. 6", September, 2014, p. 05. Non-limiting examples of the movable body may include an unmanned aerial vehicle.

In such a use, moving timing of each of the movable bodies is set and managed on the basis of a preset operation plan.

SUMMARY

It is desired that moving timing of a movable body be variable automatically on the basis of a surrounding environment of the movable body. The surrounding environment may be, for example but not limited to, a wind condition.

It is desirable to provide an operation management apparatus, an operation management method, and an operation management program that each are able to automatically set moving timing of a movable body on the basis of a surrounding environment of the movable body.

An aspect of the technology provides an operation management apparatus including a returning time setter, a surrounding environment estimating unit, an energy calculator, and a time changer. The returning time setter is configured to provisionally set a returning start time of a movable body on the basis of a proceeding start time of the movable body, a workable time period of the movable body, and an initial value of a time period necessary for returning of the movable body to a first position from a second position. The surrounding environment estimating unit is configured to estimate a surrounding environment at the returning start time of the movable body. The energy calculator is configured to search a returning route on the basis of the surrounding environment estimated by the surrounding environment estimating unit, and calculate an energy amount. The returning route is a route along which the movable body performs the returning, to the first position from the second position, that is started at the returning start time. The energy amount is an energy amount necessary for the returning, of the movable body, that is started at the returning start time. The time changer is configured to change the returning start time to be earlier by a predetermined time period until the energy amount calculated by the energy calculator becomes equal to or smaller than a predetermined allowable value. The surrounding environment estimating unit is configured to perform the estimation of the surrounding environment and the energy calculator performs the calculation of the energy amount, each time the time changer changes the returning start time.

An aspect of the technology provides an operation management apparatus including a proceeding time setter, a surrounding environment estimating unit, a time calculator, and a time changer. The proceeding time setter is configured to provisionally set a proceeding start time of a movable body on the basis of a proceeding completion target time of the movable body and an initial value of a time period necessary for proceeding of the movable body from a first position to a second position. The surrounding environment estimating unit is configured to estimate a surrounding environment at the proceeding start time of the movable body. The time calculator is configured to search a proceeding route on the basis of the surrounding environment estimated by the surrounding environment estimating unit, and calculate a proceeding completion time. The proceeding route is a route along which the movable body performs the proceeding, from the first position to the second position, that is started at the proceeding start time. The time changer is configured to change the proceeding start time to be earlier by a predetermined time period until the proceeding completion time calculated by the time calculator becomes equal to or earlier than the proceeding completion target time. The surrounding environment estimating unit is configured to perform the estimation of the surrounding environment and the time calculator is configured to perform the calculation of the proceeding completion time, each time the time changer changes the proceeding start time.

An aspect of the technology provides an operation management method including: provisionally setting a returning start time of a movable body on the basis of a proceeding start time of the movable body, a workable time period of the movable body, and an initial value of a time period necessary for returning of the movable body to a first position from a second position; estimating a surrounding environment at the returning start time of the movable body; searching a returning route on the basis of the estimated surrounding environment, the returning route being a route along which the movable body performs the returning, to the first position from the second position, that is started at the returning start time; calculating an energy amount necessary for the returning, of the movable body, that is started at the returning start time; and changing the returning start time to be earlier by a predetermined time period until the calculated energy amount becomes equal to or smaller than a predetermined allowable value. The estimating of the surrounding environment and the calculating of the energy amount are performed, each time the changing of the returning start time is performed.

An aspect of the technology provides an operation management method including: provisionally setting a proceeding start time of a movable body on the basis of a proceeding completion target time of the movable body and an initial value of a time period necessary for proceeding of the movable body from a first position to a second position; estimating a surrounding environment at the proceeding start time of the movable body; searching a proceeding route on the basis of the estimated surrounding environment, the proceeding route being a route along which the movable body performs the proceeding, from the first position to the second position, that is started at the proceeding start time; calculating an proceeding completion time; changing the proceeding start time to be earlier by a predetermined time period until the calculated proceeding completion time becomes equal to or earlier than the proceeding completion target time. The estimating of the surrounding environment and the calculating of the proceeding completion time are performed, each time the proceeding start time is changed.

An aspect of the technology provides a non-transitory recording medium containing an operation management program embodied therein. The operation management program causes, when executed by a computer, the computer to implement a method. The method includes: provisionally setting a returning start time of a movable body on the basis of a proceeding start time of the movable body, a workable time period of the movable body, and an initial value of a time period necessary for returning of the movable body to a first position from a second position; estimating a surrounding environment at the returning start time of the movable body; searching a returning route on the basis of the estimated surrounding environment, the returning route being a route along which the movable body performs the returning, to the first position from the second position, that is started at the returning start time; calculating an energy amount necessary for the returning, of the movable body, that is started at the returning start time; and changing the returning start time to be earlier by a predetermined time period until the calculated energy amount becomes equal to or smaller than a predetermined allowable value. The estimating of the surrounding environment and the calculating of the energy amount are performed, each time the changing of the returning start time is performed.

An aspect of the technology provides a non-transitory recording medium containing an operation management program embodied therein. The operation management program causes, when executed by a computer, the computer to implement a method. The method includes: provisionally setting a proceeding start time of a movable body on the basis of a proceeding completion target time of the movable body and an initial value of a time period necessary for proceeding of the movable body from a first position to a second position; estimating a surrounding environment at the proceeding start time of the movable body; searching a proceeding route on the basis of the estimated surrounding environment, the proceeding route being a route along which the movable body performs the proceeding, from the first position to the second position, that is started at the proceeding start time; calculating an proceeding completion time; changing the proceeding start time to be earlier by a predetermined time period until the calculated proceeding completion time becomes equal to or earlier than the proceeding completion target time. The estimating of the surrounding environment and the calculating of the proceeding completion time are performed, each time the proceeding start time is changed.

An aspect of the technology provides an operation management apparatus including circuitry. The circuitry is configured to provisionally set a returning start time of a movable body on the basis of a proceeding start time of the movable body, a workable time period of the movable body, and an initial value of a time period necessary for returning of the movable body to a first position from a second position. The circuitry is configured to estimate a surrounding environment at the returning start time of the movable body. The circuitry is configured to search a returning route on the basis of the estimated surrounding environment, and calculates an energy amount. The returning route is a route along which the movable body performs the returning, to the first position from the second position, that is started at the returning start time. The energy amount is an energy amount necessary for the returning, of the movable body, that is started at the returning start time. The circuitry is configured to change the returning start time to be earlier by a predetermined time period until the calculated energy amount becomes equal to or smaller than a predetermined allowable value. The estimation of the surrounding environment and the calculation of the energy amount are performed, each time the changing of the returning start time is performed.

An aspect of the technology provides an operation management apparatus including circuitry. The circuitry is configured to provisionally set a proceeding start time of a movable body on the basis of a proceeding completion target time of the movable body and an initial value of a time period necessary for proceeding of the movable body from a first position to a second position. The circuitry is configured to estimate a surrounding environment at the proceeding start time of the movable body. The circuitry is configured to search a proceeding route on the basis of the estimated surrounding environment, and calculates a proceeding completion time. The proceeding route is a route along which the movable body performs the proceeding, from the first position to the second position, that is started at the proceeding start time. The circuitry is configured to change the proceeding start time to be earlier by a predetermined time period until the calculated proceeding completion time becomes equal to or earlier than the proceeding completion target time. The estimation of the surrounding environment and the calculation of the proceeding completion time are performed, each time the changing of the proceeding start time is performed.

DETAILED DESCRIPTION

In the following, some non-limiting implementations of the technology are described in detail with reference to the accompanying drawings. Note that the following description is directed to illustrative examples of the disclosure and not to be construed as limiting to the technology. Factors including, without limitation, numerical values, shapes, materials, components, positions of the components, and how the components are coupled to each other are illustrative only and not to be construed as limiting to the technology.

Further, elements in the following example implementations which are not recited in a most-generic independent claim of the disclosure are optional and may be provided on an as-needed basis. The drawings are schematic and are not intended to be drawn to scale.

Configuration of Operation Management Apparatus

A description is given first of a configuration of an operation management apparatus 1 according to one implementation of the technology.

Figure 1:
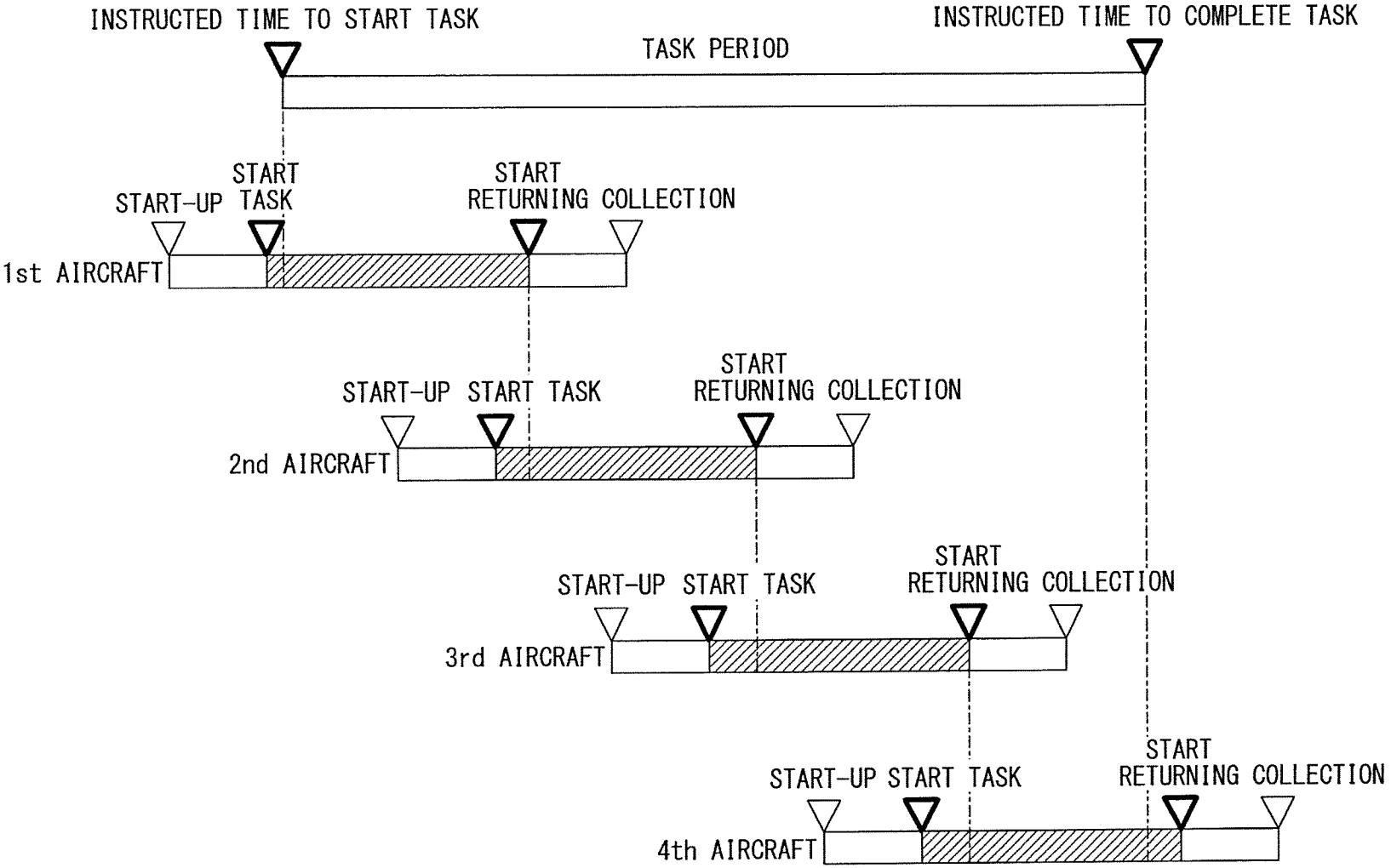
FIG. 1 is a diagram illustrating an example of operation of a plurality of unmanned aircrafts according to one implementation of the technology.
Figure 2:
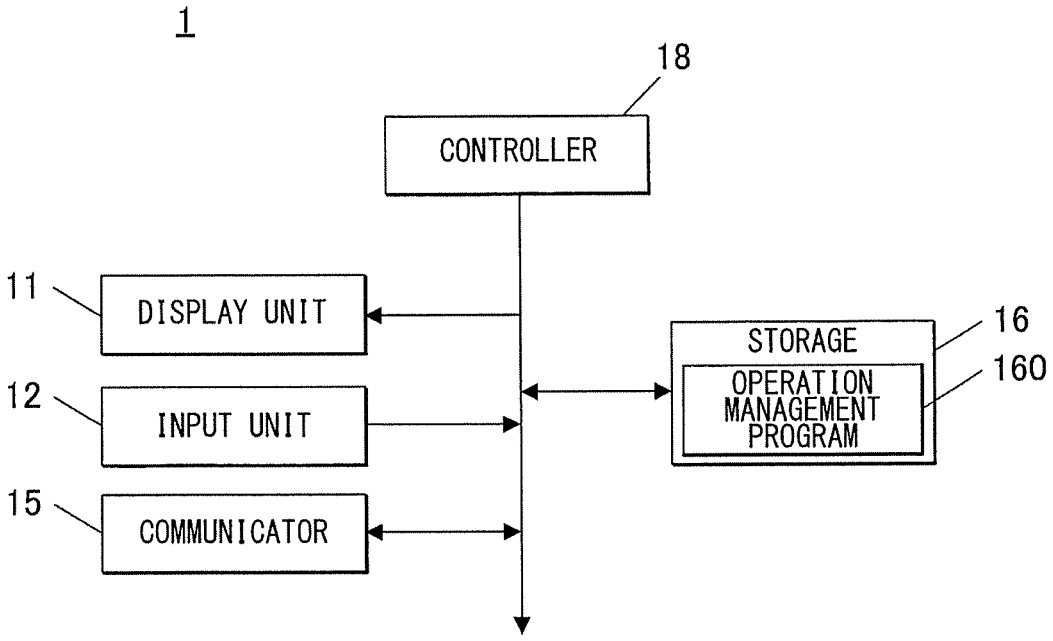
FIG. 2 is a block diagram illustrating an example of a functional configuration of an operation management apparatus for the unmanned aircrafts according to one implementation of the technology.

FIG. 1 is an operation diagram of a plurality of unmanned aircrafts 2 according to one implementation of the technology. FIG. 2 is a block diagram illustrating a functional configuration of the operation management apparatus 1.

The operation management apparatus 1 may manage operation of the plurality of unmanned aircrafts 2 in a case where the unmanned aircrafts 2 continuously perform a predetermined task in association with each other. In one implementation, each of the unmanned aircrafts 2 may be, for example but not limited to, an unmanned aerial vehicle. In one implementation, the number of the unmanned aircrafts 2 may be, for example but not limited to, four. As illustrated in FIG. 1 by way of example, in one implementation, the task may be to continuously maintain a state in which at least one of the unmanned aircrafts 2 is located at a task position during a predetermined task period, while causing the unmanned aircrafts 2 to perform proceeding and returning in turns. The proceeding may be performed from a departure-arrival base to the task position, and the returning may be performed from the task position to the departure-arrival base. This task may be directed to, for example but not limited to, monitoring of a predetermined target. In one implementation, the unmanned aircraft 2 may serve as a "movable body". In one implementation, the departure-arrival base may serve as a "first position". In one implementation, the task position may serve as a "second position".

In one specific but non-limiting implementation, the operation management apparatus 1 may be provided at the departure-arrival base for the unmanned aircrafts 2. Referring to FIG. 2, the operation management apparatus 1 may include a display unit 11, an input unit 12, a communicator 15, a storage 16, and a controller 18.

The display unit 11 may include an unillustrated display. The display unit 11 may display, on the display, various pieces of information on the basis of a display signal supplied from the controller 18.

The input unit 12 may include an unillustrated input receiving device. The input unit 12 may output, to the controller 18, a signal corresponding to an input operation performed on the input receiving device by an operator.

The communicator 15 may perform communication between each of the unmanned aircrafts 2 and the communicator 15. The communicator 15 and each of the unmanned aircrafts 2 may be able to perform transmission and reception of various signals between the communicator 15 and the relevant unmanned aircraft 2. Further, the communicator 15 and each of the unmanned aircrafts 2 may be able to acquire various pieces of information by means of connection to a communication network.

The storage 16 may be a memory that stores, for example but not limited to, a program and data that are directed to achievement of various functions of the operation management apparatus 1, and also serves as a workspace. In one implementation, the storage 16 may store an operation management program 160.

The operation management program 160 may cause the controller 18 to execute an operation management process which will be described later with reference to FIGS. 4 to 7.

The controller 18 may perform a central control of each unit of the operation management apparatus 1. Specifically, the controller 18 may output a control instruction to each of the unmanned aircrafts 2 via the communicator 15. Further, the controller 18 may load the program stored in the storage 16 and execute various processes in association with the loaded program. Further, the controller 18 may perform any other operation. In one implementation, the controller 18 may serve as a "returning time setter", a "proceeding time setter", a "surrounding environment estimating unit", an "energy calculator", a "time changer", and a "time calculator".

Configuration of Unmanned Aircraft

A description is given next of a configuration of each of the unmanned aircrafts 2.

Figure 3:
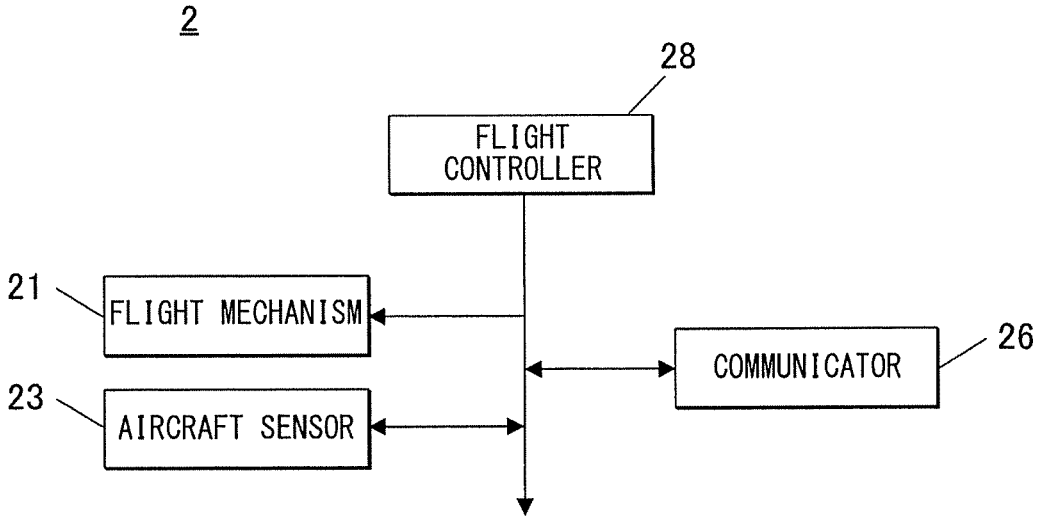
FIG. 3 is a block diagram illustrating an example of a functional configuration of any of the unmanned aircrafts according to one implementation of the technology.

FIG. 3 is a block diagram illustrating a functional configuration of any of the unmanned aircrafts 2.

Referring to FIG. 3, each of the unmanned aircrafts 2 may include a flight mechanism 21, an aircraft sensor 23, a communicator 26, and a flight controller 28. The flight mechanism 21 may allow for flight of the relevant one of the unmanned aircrafts 2.

The aircraft sensor 23 may include various sensors directed to detection of a flight state of the relevant unmanned aircraft 2 and acquisition of information regarding a surrounding environment of the relevant unmanned aircraft 2. The information regarding the surrounding environment of any of the unmanned aircrafts 2 may be hereinafter referred to as "surrounding environment information". The aircraft sensor 23 may include, for example but not limited to, a radar, an image sensor, a gyroscope, a velocity sensor, a global positioning system (GPS), and a traffic alert and collision avoidance system (TCAS). Non-limiting examples of the image sensor may include a camera. The aircraft sensor 23 may acquire various pieces of information, i.e., the surrounding environment information, on the basis of a control instruction given from the flight controller 28, and output, to the flight controller 28, a signal regarding the acquired various pieces of information, i.e., the acquired surrounding environment information.

The communicator 26 may be able to perform communication with the operation management apparatus 1, any unmanned aircraft 2 other than the relevant unmanned aircraft 2, or any other communication partner to allow for mutual transmission and mutual reception of various signals. The communicator 26 may also be able to acquire various pieces of information by means of connection to a communication network.

Further, the communicator 26 may perform transmission and reception of an automatic dependent surveillance-broadcast (ADS-B) signal including various pieces of information such as an identifier, a current position, an altitude, and an airspeed.

The flight controller 28 may perform a central control of each unit of the relevant unmanned aircraft 2. Specifically, the flight controller 28 may perform a control of the flight of the relevant unmanned aircraft 2 by performing a drive control of the flight mechanism 21 on the basis of a control instruction given from the operation management apparatus 1. Further, the flight controller 28 may perform a control of an operation of the aircraft sensor 23 on the basis of a control instruction given from the operation management apparatus 1. Further, the flight controller 28 may perform any other control on the basis of a control instruction given from the operation management apparatus 1.

Operation of Operation Management Apparatus

A description is given next of an operation of the operation management apparatus 1 to be performed upon execution of the operation management process.

Figure 4:
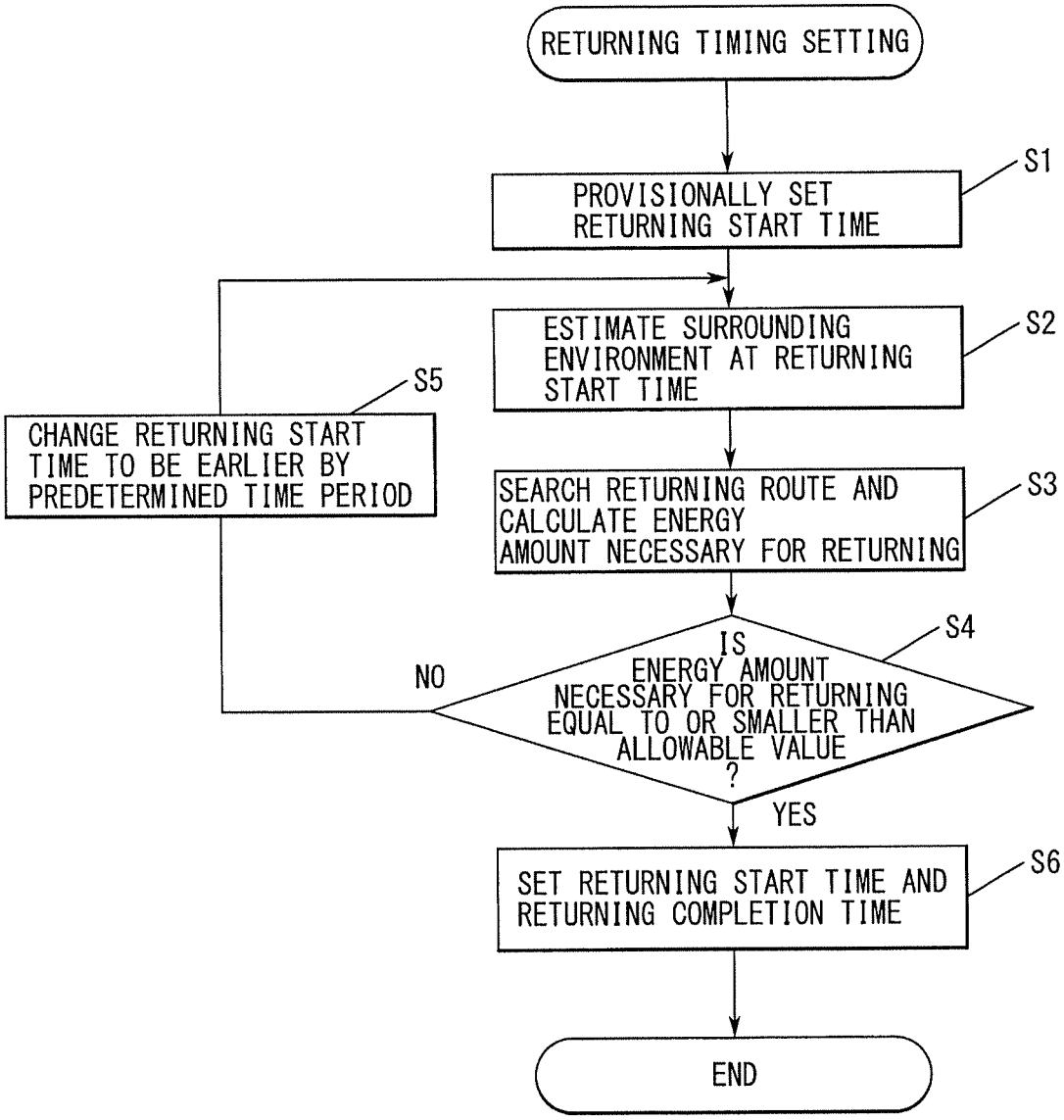
FIG. 4 is a flowchart illustrating an example of a flow of a process of setting returning timing of any of the unmanned aircrafts, in an operation management process according to one implementation of the technology.
Figure 5:
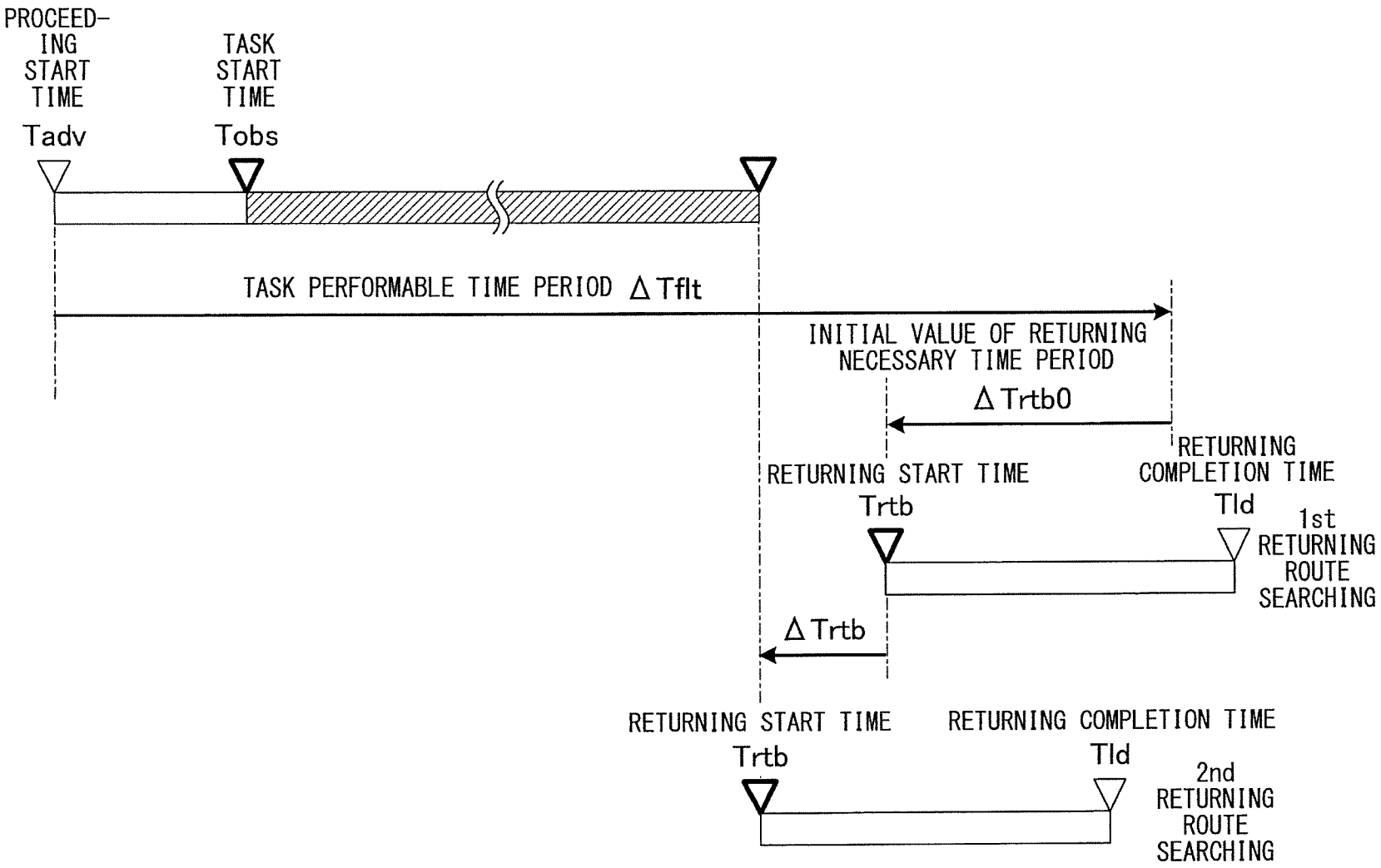
FIG. 5 describes an example of the process of setting the returning timing of any of the unmanned aircrafts according to one implementation of the technology.
Figure 6:
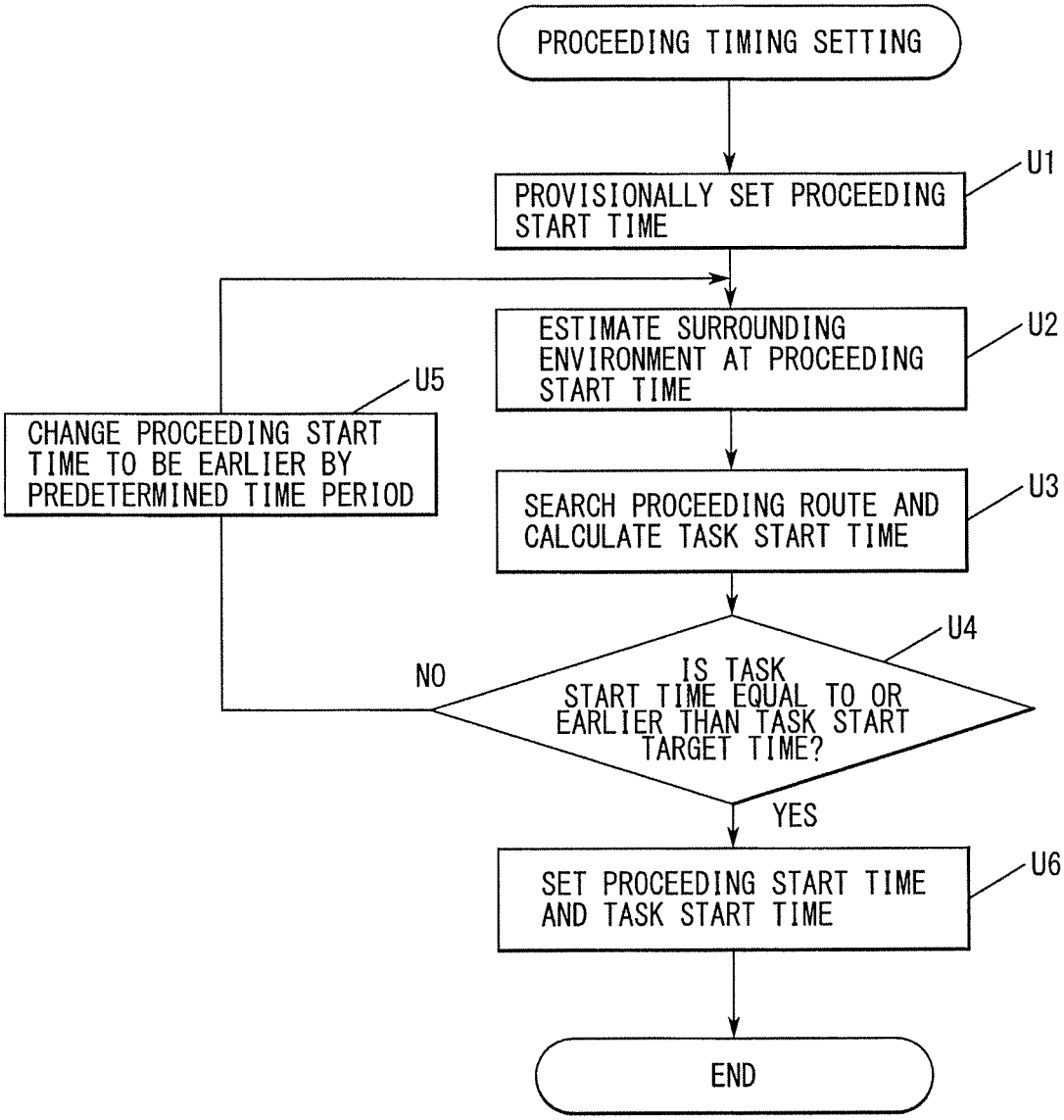
FIG. 6 is a flowchart illustrating an example of a flow of a process of setting proceeding timing of any of the unmanned aircrafts, in the operation management process according to one implementation of the technology.
Figure 7:
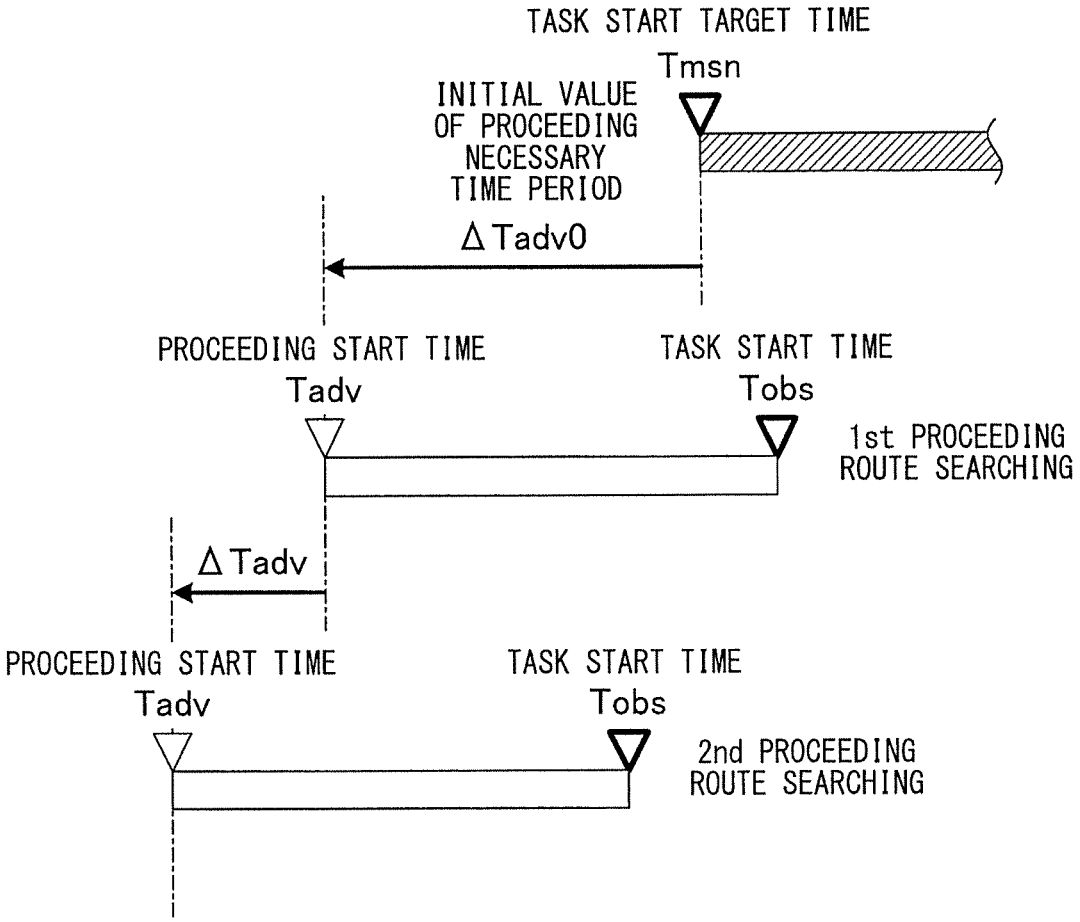
FIG. 7 describes an example of the process of setting the proceeding timing of any of the unmanned aircrafts according to one implementation of the technology.

FIG. 4 is a flowchart illustrating a flow of a process of setting returning timing of any of the unmanned aircrafts 2, which is part of the operation management process. FIG. 5 is a diagram describing the process of setting the returning timing of any of the unmanned aircrafts 2. FIG. 6 is a flowchart illustrating a flow of a process of setting proceeding timing of any of the unmanned aircrafts 2, which is part of the operation management process. FIG. 7 is a diagram describing the process of setting the proceeding timing of any of the unmanned aircrafts 2.

The operation management process may set moving timing of the plurality of unmanned aircrafts 2 that sequentially proceed from the departure-arrival base to the task position and sequentially return from the task position to the departure-arrival base. The moving timing may include one or both of returning timing and proceeding timing both of which will be described later. In one implementation, the operation management process may set, in particular, the proceeding timing and the returning timing of the unmanned aircrafts 2. The operation management process may be executed on an example condition that an instruction to execute the operation management process is inputted. The input of the instruction may be performed through, for example but not limited to, an operation performed by the operator. The execution of the operation management process may be performed by reading and loading, by the controller 18, of the operation management program 160 from the storage 16.

It is to be noted that, as used hereinafter, the term "returning" and its variants may refer to a sequence from departure of any of the unmanned aircrafts 2 from the task position to arrival of the relevant unmanned aircraft 2 at the departure-arrival base, i.e., by landing and stopping of the relevant unmanned aircraft 2, unless otherwise noted. The term "returning" may encompass "collection", unless otherwise noted. The term "collection" may refer to a sequence from arrival of the relevant unmanned aircraft 2 at the vicinity of the departure-arrival base to the landing and the stopping of the relevant unmanned aircraft 2, unless otherwise noted.

As used hereinafter, the term "proceeding" and its variants may refer to a sequence from start of an operation of the relevant unmanned aircraft 2 at the departure-arrival base to arrival of the relevant unmanned aircraft 2 at the task position, unless otherwise noted. The term "proceeding" may encompass "starting-up", unless otherwise noted. The term "starting-up" may refer to a sequence from the start of the operation of the relevant unmanned aircraft 2 at the departure-arrival base to a state in which the relevant unmanned aircraft 2 is ready to move forward by being raised, unless otherwise noted.

Setting of Returning Timing

A description is first given of the process of setting the returning timing, i.e., a returning start time, at which any of the unmanned aircrafts 2 starts the returning from the task position to the departure-arrival base. The process of setting the returning timing may be part of the operation management process. The returning timing may be so set as not to cause insufficiency of energy until the relevant unmanned aircraft 2 is collected, i.e., until the returning of the relevant unmanned aircraft 2 is completed. The energy may be, for example but not limited to, fuel.

A description is given below of an example case where the returning start time Trtb of a predetermined one of the unmanned aircrafts 2 is set. In the example case described below, the predetermined one of the unmanned aircrafts 2 is currently performing the task of monitoring at the task position, following the proceeding to the task position.

Referring to FIGS. 4 and 5, first, the controller 18 provisionally sets the returning start time Trtb on the basis of a proceeding start time Tadv of the predetermined unmanned aircraft 2, a task performable time period ΔTflt of the predetermined unmanned aircraft 2, and an initial value ΔTrtb0 of a returning necessary time period of the predetermined unmanned aircraft 2 (step S1). In one implementation, the task performable time period may serve as a "workable time period".

Specifically, the controller 18 may provisionally set, as the returning start time Trtb, a time that is earlier, by the initial value ΔTrtb0 of the returning necessary time period, than a performable time. The performable time is a time that is later than the proceeding start time Tadv by the task performable time period ΔTflt. The returning start time Trtb may be a time at which the predetermined unmanned aircraft 2 is to start the returning from the task position to the departure-arrival base. The proceeding start time Tadv may be a time at which the predetermined unmanned aircraft 2 starts the proceeding from the departure-arrival base to the task position. The task performable time period ΔTflt may be a time period during which the predetermined unmanned aircraft 2 is able to perform the task. The task performable time period ΔTflt may be determined in advance on the basis of a factor, related to the predetermined unmanned aircraft 2, such as an amount of the fuel on board and an amount of consumed fuel. The initial value ΔTrtb0 of the returning necessary time period may be an initial value of a time period that is necessary for the predetermined unmanned aircraft 2 to perform the returning from the task position to the departure-arrival base under a simple surrounding environment condition or any other suitable condition. The simple surrounding environment condition may be, for example but not limited to, a condition with no wind. The initial value ΔTrtb0 of the returning necessary time period may be determined in advance.

Thereafter, the controller 18 may estimate the surrounding environment at the returning start time Trtb in the future of the predetermined unmanned aircraft 2 (step S2).

In step S2, the controller 18 may acquire, as the surrounding environment information, the surrounding environment information that may possibly influence searching of a returning route of the predetermined unmanned aircraft 2 in step S3 which will be described later. Specifically, the controller 18 may acquire position information of the predetermined unmanned aircraft 2, position information of any other aircraft, and any other information by the aircraft sensor 23, the communicator 26, and any other unit, of the predetermined unmanned aircraft 2. The controller 18 may also acquire, as the surrounding environment information, weather information and any other information by the communicator 15 of the predetermined unmanned aircraft 2. In one implementation, the controller 18 may acquire a wind condition on the basis of numerical weather forecasting, significant meteorological information (SIGMET), and any other information, obtainable from, for example but not limited to, a meteorological observatory. The wind condition may include, for example but not limited to, a wind speed and a wind direction. Further, the controller 18 may also acquire information regarding any other aircraft on the basis of the ADS-B signal. Further, the controller 18 may also acquire information regarding a limited airspace on the basis of, for example but not limited to, notice to airman (NOTAM). The NOTAM includes various pieces of information regarding aviation obtainable from, for example but not limited to, aviation authorities. The controller 18 may directly acquire, of the pieces of information mentioned above, the information, regarding the wind condition and the information regarding any other aircraft, estimated at a predetermined temporal interval in a predetermined time period.

The controller 18 estimates the surrounding environment of the predetermined unmanned aircraft 2 at the returning start time Trtb in the future on the basis of the foregoing surrounding environment information. In one implementation, the controller 18 may estimate not only the surrounding environment, of the predetermined unmanned aircraft 2, at the returning start time Trtb at which the predetermined unmanned aircraft 2 is to start the returning, but also that the surrounding environment at a time in the middle of the returning of the predetermined unmanned aircraft 2.

Thereafter, the controller 18 searches a returning route of the predetermined unmanned aircraft 2 (step S3). The returning route of the predetermined unmanned aircraft 2 may be a route along which the predetermined unmanned aircraft 2 is to follow from departure from the task position at the returning start time Trtb and arrival at the departure-arrival base. More specifically, the controller 18 may perform the searching of the returning route of the predetermined unmanned aircraft 2 while taking into consideration the surrounding environment at the returning start time Trtb estimated in step S2, and calculates an energy amount that is necessary for the returning of the predetermined unmanned aircraft 2. The energy amount may be, for example but not limited to, an amount of the fuel of the predetermined unmanned aircraft 2. In one implementation, a route that requires the smallest energy amount to achieve the returning, a route that minimizes the degree of hindrance to the task caused by the surrounding environment, or any other route may be searched as the returning path to be searched upon the searching of the returning route.

Thereafter, the controller 18 may determine whether the energy amount necessary for the returning calculated in step S3 is equal to or smaller than a preset allowable value (step S4). In other words, in step S4, a determination may be made as to whether the energy amount necessary for the returning calculated in step S3 does not cause insufficiency of the energy amount in a case where the predetermined unmanned aircraft 2 starts the returning at the set returning start time Trtb.

When a determination is made that the energy amount necessary for the returning is greater than the allowable value in step S4 (step S4: NO), the controller 18 may change the returning start time Trtb to be earlier by a predetermined time period ΔTrtb (step S5). Thereafter, the flow may return to the process in step S2 described above.

The predetermined time period ΔTrtb by which the returning start time Trtb is changed to be earlier is not particularly limited. In one implementation, the predetermined time period ΔTrtb may be a certain time period such as an hour. In another implementation, the predetermined time period ΔTrtb may be varied in accordance with an amount by which the energy amount necessary for the returning is greater than the allowable value.

In contrast, when a determination is made that the energy amount necessary for the returning is equal to or smaller than the allowable value in step S4 (step S4: YES), the controller 18 may set the current returning start time Trtb and a current returning completion time Tld as setting values at present, and store the set setting values in the storage 16 (step S6). In one implementation, the controller 18 may update the setting values at present by the current returning start time Trtb and the current returning completion time Tld, and store the updated setting values in the storage 16. The returning completion time Tld may be a time at which the predetermined unmanned aircraft 2 is to complete the returning.

This may end the setting, i.e., the changing, of the returning start time Trtb.

As described above, in the process of setting the returning timing, the estimation of the surrounding environment at the returning start time Trtb and the calculation of the energy amount necessary for the returning are repeated until the calculated energy amount necessary for the returning becomes equal to or less than the predetermined allowable value, while the returning start time Trtb is changed to be earlier by the predetermined time period ΔTrtb. In other words, in the process of setting the returning timing, the returning start time Trtb may be changed to be earlier by the predetermined time period ΔTrtb until the calculated energy amount necessary for the returning becomes equal to or smaller than the predetermined allowable value. The estimation of the surrounding environment at the returning start time Trtb and the calculation of the energy amount necessary for the returning are performed Each time the returning start time Trtb is changed, each time the returning start time Trtb is changed.

Thus, the returning start time Trtb is automatically set that allows for the returning of the predetermined unmanned aircraft 2 without causing insufficiency of the energy amount necessary for the returning. Such automatic setting of the returning start time Trtb is performed while taking into consideration the surrounding environment at the returning start time Trtb of the predetermined unmanned aircraft 2 and the returning route of the predetermined unmanned aircraft 2.

Setting of Proceeding Timing

A description is given next of the process of setting the proceeding timing, i.e., a proceeding start time, at which any of the unmanned aircrafts 2 starts the proceeding from the departure-arrival base to the task position. The process of setting the proceeding timing may be part of the operation management process. The proceeding timing may be so set that the proceeding of the unmanned aircraft 2 is completed on or before the returning start time of the previous unmanned aircraft 2. In a case where the proceeding timing of the unmanned aircraft 2 that is the first to perform the proceeding is set, the proceeding timing may be so set that the proceeding of the unmanned aircraft 2 is completed on or before a time at which the unmanned aircraft 2 is instructed to start the task.

A description is given below of an example case where the proceeding start time Tadv of a predetermined one of the unmanned aircrafts 2 is set. In an example case described below, the predetermined unmanned aircraft 2 may be in a standby state at the departure-arrival base, and be a replacement for the previous unmanned aircraft 2 that is currently performing the task of monitoring.

Referring to FIGS. 6 and 7, first, the controller 18 provisionally sets the proceeding start time Tadv on the basis of a task start target time Tmsn of the predetermined unmanned aircraft 2 and an initial value ΔTadv0 of a proceeding necessary time period of the predetermined unmanned aircraft 2 (step U1). In one implementation, the task start target time Tmsn may serve as a "proceeding completion target time".

Specifically, the controller 18 may provisionally set, as the proceeding start time Tadv, a time that is earlier than the task start target time Tmsn by the initial value ΔTadv0 of the proceeding necessary time period. The proceeding start time Tadv may be a time at which the predetermined unmanned aircraft 2 is to start the proceeding from the departure-arrival base to the task position. The task start target time Tmsn may be an instructed time at which the task is to be started which is illustrated in FIG. 1, when the predetermined unmanned aircraft 2 is the unmanned aircraft that is the first to perform the proceeding. The task start target time Tmsn may be the returning start time Trtb of the previous unmanned aircraft 2 illustrated in FIG. 5, when the predetermined unmanned aircraft 2 is the unmanned aircraft 2 that is the second to perform the proceeding or the unmanned aircraft 2 that performs the proceeding thereafter. The initial value ΔTadv0 of the proceeding necessary time period may be an initial value of a time period that is necessary for the predetermined unmanned aircraft 2 to perform the proceeding from the departure-arrival base to the task position under a simple surrounding environment condition or any other suitable condition. The simple surrounding environment condition may be, for example but not limited to, a condition with no wind. The initial value ΔTadv0 of the proceeding necessary time period may be determined in advance.

Thereafter, the controller 18 may estimate the surrounding environment at the proceeding start time Tadv in the future of the predetermined unmanned aircraft 2 (step U2).

In step U2, the controller 18 may acquire the surrounding environment information that may possibly influence searching of a proceeding route of the predetermined unmanned aircraft 2 in step U3 which will be described later. Specifically, the controller 18 may acquire, as the surrounding environment information, position information of any other aircraft and any other information by the aircraft sensor 23, the communicator 26, any other unit of the predetermined unmanned aircraft 2, or any facility in the departure-arrival base. The controller 18 may also acquire, as the surrounding environment information, weather information and any other information by the communicator 15 of the predetermined unmanned aircraft 2. In one implementation, the controller 18 may acquire pieces of information regarding the wind condition, any other aircraft, and the limited airspace, in a manner similar to that in step S2 in the setting of the returning start time Trtb described above.

The controller 18 estimates the surrounding environment at the proceeding start time Tadv in the future of the predetermined unmanned aircraft 2 on the basis of the foregoing surrounding environment information. In one implementation, the controller 18 may estimate not only the surrounding environment, of the predetermined unmanned aircraft 2, at the proceeding start time Tadv at which the predetermined unmanned aircraft 2 is to start the proceeding, but also that the surrounding environment at a time in the middle of the proceeding of the predetermined unmanned aircraft 2.

Thereafter, the controller 18 searches a proceeding route of the predetermined unmanned aircraft 2 (step U3). The proceeding route of the predetermined unmanned aircraft 2 may be a route along which the predetermined unmanned aircraft 2 is to follow from departure from the departure-arrival base at the proceeding start time Tadv to arrival at the task position. More specifically, the controller 18 may perform the searching of the proceeding route of the predetermined unmanned aircraft 2 while taking into consideration the surrounding environment at the proceeding start time Tadv estimated in step S2, and calculates a task start time Tobs, i.e., a proceeding completion time. The task start time Tobs may be a time at which the predetermined unmanned aircraft 2 is to start the task. The proceeding completion target time may be a time at which the proceeding of the predetermined unmanned aircraft 2 is to be completed. The searching of the proceeding route in step U3 may be performed in a manner similar to that in step S3 in the process of setting the returning start time described above.

Thereafter, the controller 18 may determine whether the task start time Tobs, i.e., the proceeding completion time, calculated in step U3 is equal to or earlier than the task start target time Tmsn, i.e., the proceeding completion target time (step U4).

When a determination is made that the the task start time Tobs is later than the task start target time Tmsn in step U4 (step U4: NO), the controller 18 may change the proceeding start time Tadv to be earlier by a predetermined time period ΔTadv (step U5). Thereafter, the flow may return to the process in step U2 described above.

The predetermined time period ΔTadv by which the proceeding start time Tadv is changed to be earlier is not particularly limited. In one implementation, the predetermined time period ΔTadv may be a certain time period such as an hour. In another implementation, the predetermined time period ΔTadv may be varied in accordance with an amount of time by which the task start time Tobs is later than the task start target time Tmsn.

In contrast, when a determination is made that the task start time Tobs is equal to or earlier than the task start target time Tmsn in step U4 (step U4: YES), the controller 18 may set the current proceeding start time Tadv and the current task start time Tobs as setting values at present, and store the set setting values in the storage 16 (step U6). In one implementation, the controller 18 may update the setting values at present by the current proceeding start time Tadv and the current task start time Tobs, and store the updated setting values in the storage 16.

This may end the setting, i.e., the changing, of the proceeding start time Tadv.

As described above, in the process of setting the advancing timing, the estimation of the surrounding environment at the advancing start time Tadv and the calculation of the task starting time Tobs are repeated until the the task start time Tobs becomes equal to or earlier than the task start target time Tmsn, while the advancing start time Tadv is changed to be earlier by the predetermined time period ΔTadv In other words, in the process of setting the proceeding timing, the proceeding start time Tadv is changed to be earlier by the predetermined time period ΔTadv until the task start time Tobs becomes equal to or earlier than the task start target time Tmsn. Each time the proceeding start time Tadv is changed, the estimation of the surrounding environment at the proceeding start time Tadv and the calculation of the task start time Tobs are performed.

Thus, the proceeding start time Tadv is automatically set that allows the proceeding completion time of the predetermined unmanned aircraft 2 to be equal to or earlier than the task start target time Tmsn. Such automatic setting of the proceeding start time Tadv is performed while taking into consideration the surrounding environment at the proceeding start time Tadv of the predetermined unmanned aircraft 2 and the proceeding route of the predetermined unmanned aircraft 2.

The above-described process of setting the returning start time Trtb and the above-described process of setting the proceeding start time Tadv may be alternately applied to the subsequent unmanned aircrafts 2 in turns, so that the overall operation schedule reflects such processes. Further, the processes of setting the returning start time Trtb and the proceeding start time Tadv may be executed, as appropriate, during a period in which the task is to be performed. This updates, as appropriate, the operation schedule to the latest schedule reflecting a variation in a factor such as the surrounding environment and the moving route of the unmanned aircraft 2 that is currently performing the task.

Effects

One example use of a movable body is continuous monitoring by a plurality of movable bodies that perform monitoring in turns. Non-limiting examples of the movable body may include an unmanned aerial vehicle. In this kind of use of the movable body such as the monitoring performed by the plurality of movable bodies in turns, the moving timing of each of the movable bodies is set and managed on the basis of a preset operation plan.

During the operation of the movable bodies, a factor such as a surrounding environment and a moving route related to the movable bodies may be possibly varied from those set in the operation plan in some cases. The surrounding environment of the movable body may be, for example but not limited to, a wind condition. The variation in the factor related to the movable body may possibly cause, in turn, variation in a time period during which the movable body is able to perform an assigned task. Therefore, when the factor such as the surrounding environment and the moving route of the movable body is varied, it may be necessary to change the moving timing of the movable body accordingly. However, in an existing technique, it has been necessary for an operation manager to manually change the moving timing of the movable body while taking into consideration the variation in the factor such as the surrounding environment and the moving route of the movable body. This has been increased a load in a task of the operation manager.

In contrast, according to one implementation of the technology, the returning start time Trtb is provisionally set on the basis of the proceeding start time Tadv of the unmanned aircraft 2, the task performable time period ΔTflt of the unmanned aircraft 2, and the initial value ΔTrtb0 of the returning necessary time period of the unmanned aircraft 2. Further, the surrounding environment at the provisionally-set returning start time Trtb of the unmanned aircraft 2 is estimated. Further, the returning route is searched on the basis of the estimated surrounding environment, and the energy amount is calculated. The returning route is a route along which the unmanned aircraft 2 performs the returning, to the departure-arrival base from the task position, that is started at the returning start time Trtb. The energy amount is an energy amount necessary for the returning, of the unmanned aircraft 2, that is started at the returning start time Trtb. The energy amount may be, for example but not limited to, the amount of fuel of the unmanned aircraft 2. Further, the returning start time Trtb is changed to be earlier by the predetermined time period ΔTrtb until the calculated energy amount becomes equal to or smaller than the predetermined allowable value. Each time the returning start time Trtb is changed, the estimation of the surrounding environment at the returning start time Trtb of the unmanned aircraft 2 and the calculation of the energy amount necessary for the returning of the unmanned aircraft 2 are performed.

This makes it possible to automatically set the returning start time Trtb that allows for the returning of the unmanned aircraft 2 without causing insufficiency of the energy amount necessary for the returning. Such automatic setting of the returning start time Trtb is performed while taking into consideration the surrounding environment at the returning start time Trtb of the unmanned aircraft 2 and the returning route of the unmanned aircraft 2.

Hence, it is possible to automatically set the moving timing of the unmanned aircraft 2 while taking into consideration the variation in the factor such as the surrounding environment of the unmanned aircraft 2 and the moving route of the unmanned aircraft 2.

Moreover, the proceeding start time Tadv of the unmanned aircraft 2 is provisionally set on the basis of the task start target time Tmsn of the unmanned aircraft 2 and the initial value ΔTadv0 of the proceeding necessary time period of the unmanned aircraft 2. Further, the surrounding environment at the provisionally-set proceeding start time Tadv of the unmanned aircraft 2 is estimated. Further, the proceeding route is searched on the basis of the estimated surrounding environment, and the proceeding completion time, i.e., the task start time Tobs, is calculated. The proceeding route is a route along which the unmanned aircraft 2 performs the proceeding, from the departure-arrival base to the task position, that is started at the proceeding start time Tadv. Further, the proceeding start time Tadv is changed to be earlier by the predetermined time period ΔTadv until the calculated proceeding completion time becomes equal to or earlier than the task start target time Tmsn. Each time the proceeding start time Tadv is changed, the estimation of the surrounding environment at the proceeding start time Tadv of the unmanned aircraft 2 and the calculation of the proceeding completion time are performed.

This makes it possible to automatically set the proceeding start time Tadv that allows the proceeding completion time of the unmanned aircraft 2 to be equal to or earlier than the task start target time Tmsn. Such automatic setting of the proceeding start time Tadv is performed while taking into consideration the surrounding environment at the proceeding start time Tadv of the unmanned aircraft 2 and the proceeding route of the unmanned aircraft 2.

Hence, it is possible to automatically set the moving timing of the unmanned aircraft 2 while taking into consideration the variation in the factor such as the surrounding environment of the unmanned aircraft 2 and the moving route of the unmanned aircraft 2.

Modification Examples

Although some implementations of the technology have been described in the foregoing with reference to the accompanying drawings, the technology is by no means limited to the implementations described above. It should be appreciated that modifications and alterations may be made by persons skilled in the art without departing from the scope as defined by the appended claims. The technology is intended to include such modifications and alterations in so far as they fall within the scope of the appended claims or the equivalents thereof.

For example, the "returning" encompasses the "collection" in the example implementation described above. In an alternative example implementation, however, the "returning" may not encompass the "collection" and may be classified separately from the "collection". The "collection" is a sequence from landing of the unmanned aircraft 2 from the vicinity of the departure-arrival base to stopping of the relevant unmanned aircraft 2. Specifically, the "returning" and its variants may be a sequence from the departure of the unmanned aircraft 2 from the task position to the arrival of the unmanned aircraft 2 at the vicinity of the departure-arrival base. The vicinity of the departure-arrival base may be, for example but not limited to, a region in the air above the departure-arrival base. In this example implementation, a route to the vicinity of the departure-arrival base may be searched upon the searching of the returning route (step S3) in the process of setting the returning start time. Further, after the energy amount necessary for the returning becomes equal to or smaller than the allowable value (step S4: YES), a collection completion time may be determined on the basis of the returning completion time, i.e., a collection start time, and a preset time period necessary for the collection in step S6. The collection completion time may be a time at which the collection of the unmanned aircraft 2 is to be completed. The returning completion time may be a time at which the returning of the unmanned aircraft 2 is to be completed. The collection start time may be a time at which the collection of the unmanned aircraft 2 is to be started.

Similarly, in another alternative example implementation, the "proceeding" may not encompass the "starting-up" and may be classified separately from the "starting-up". The "starting-up" may be a sequence from the start of the operation of the unmanned aircraft 2 at the departure-arrival base to a state in which the unmanned aircraft 2 is ready to move forward by being raised. Specifically, the "proceeding" and its variants may be a sequence from the state of the unmanned aircraft 2 that is ready to move forward to the arrival of the unmanned aircraft 2 at the task position. In this example implementation, a route from the vicinity of the departure-arrival base may be searched upon the searching of the proceeding route (step U3) in the process of setting the proceeding start time. Further, after the task start time becomes equal to or earlier than the task start target time (step U4: YES), a starting-up start time may be determined on the basis of the proceeding start time and a preset time period necessary for the starting-up in step U6. The starting-up start time may be a time at which the starting-up of the unmanned aircraft 2 is to be started.

Moreover, an implementation has been described above by referring to an example case in which the preset operation plan, i.e., the preset moving timing of the unmanned aircraft 2, is changed during the execution of the task. In an alternative implementation, however, any implementation of the technology may be suitably applied to initial setting of the operation plan.

Moreover, an implementation has been described by referring to an example case in which the plurality of unmanned aircrafts 2 sequentially proceed from the departure-arrival base to the task position to perform a predetermined task at the task position. In an alternative implementation of the technology, however, it is not necessary for the plurality of movable bodies to perform a predetermined task at the task position serving as the second position, as long as the movable bodies sequentially perform the proceeding from the first position to the second position and the returning from the second position to the first position.

Moreover, the movable body is not limited to the unmanned aircraft or the unmanned aerial vehicle. In an alternative implementation of the technology, the movable body may be, for example but not limited to, a manned aerial vehicle, a vessel, or any other movable body.

The controller 18 illustrated in FIG. 1 is implementable by circuitry including at least one semiconductor integrated circuit such as at least one processor (e.g., a central processing unit (CPU)), at least one application specific integrated circuit (ASIC), and/or at least one field programmable gate array (FPGA). At least one processor is configurable, by reading instructions from at least one machine readable tangible medium, to perform all or a part of functions of the controller 18. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and a SRAM, and the nonvolatile memory may include a ROM and a NVRAM. The ASIC is an integrated circuit (IC) customized to perform, and the FPGA is an integrated circuit designed to be configured after manufacturing in order to perform, all or a part of the functions of the controller 18 illustrated in FIG. 1.

The invention claimed is:

1. An operation management method comprising:

provisionally setting a returning start time of a movable body on a basis of a proceeding start time of the movable body, a workable time period of the movable body, and an initial value of a time period necessary for returning of the movable body to a first position from a second position;

estimating a surrounding environment at the returning start time of the movable body;

searching a returning route on a basis of the estimated surrounding environment, the returning route being a route along which the movable body performs the returning, to the first position from the second position, that is started at the returning start time;

calculating an energy amount necessary for the returning, of the movable body, that is started at the returning start time;

changing the returning start time to be earlier by a predetermined time period until the calculated energy amount necessary for the returning becomes equal to or smaller than an amount of fuel for the movable body, the estimating of the surrounding environment and the calculating of the energy amount being performed, each time the changing of the returning start time is performed; and providing a control instruction to the movable body to return to the first position at the returning start time corresponding to the energy amount that is equal to or smaller than the amount of fuel for the movable body.

2. An operation management method comprising:

provisionally setting a proceeding start time of a movable body on a basis of a proceeding completion target time of the movable body and an initial value of a time period necessary for proceeding of the movable body from a first position to a second position;

estimating a surrounding environment at the proceeding start time of the movable body;

searching a proceeding route on a basis of the estimated surrounding environment, the proceeding route being a route along which the movable body performs the proceeding, from the first position to the second position, that is started at the proceeding start time;

calculating an proceeding completion time;

changing the proceeding start time to be earlier by a predetermined time period until the calculated proceeding completion time becomes equal to or earlier than the proceeding completion target time, the estimating of the surrounding environment and the calculating of the proceeding completion time being performed, each time the proceeding start time is changed; and providing a control instruction to the movable body to proceed to the second position at the proceeding start time corresponding to the proceeding completion time that is equal to or earlier than the proceeding completion target time.

3. A non-transitory recording medium containing an operation management program embodied therein, the operation management program causing, when executed by a computer, the computer to implement a method, the method comprising:

provisionally setting a returning start time of a movable body on a basis of a proceeding start time of the movable body, a workable time period of the movable body, and an initial value of a time period necessary for returning of the movable body to a first position from a second position;

estimating a surrounding environment at the returning start time of the movable body;

searching a returning route on a basis of the estimated surrounding environment, the returning route being a route along which the movable body performs the returning, to the first position from the second position, that is started at the returning start time;

calculating an energy amount necessary for the returning, of the movable body, that is started at the returning start time;

changing the returning start time to be earlier by a predetermined time period until the calculated energy amount necessary for the returning becomes equal to or smaller than an amount of fuel for the movable body, the estimating of the surrounding environment and the calculating of the energy amount being performed, each time the changing of the returning start time is performed; and providing a control instruction to the movable body to return to the first position at the returning start time corresponding to the energy amount that is equal to or smaller than the amount of fuel for the movable body.

4. A non-transitory recording medium containing an operation management program embodied therein, the operation management program causing, when executed by a computer, the computer to implement a method, the method comprising:

provisionally setting a proceeding start time of a movable body on a basis of a proceeding completion target time of the movable body and an initial value of a time period necessary for proceeding of the movable body from a first position to a second position;

estimating a surrounding environment at the proceeding start time of the movable body;

searching a proceeding route on a basis of the estimated surrounding environment, the proceeding route being a route along which the movable body performs the proceeding, from the first position to the second position, that is started at the proceeding start time;

calculating an proceeding completion time;

changing the proceeding start time to be earlier by a predetermined time period until the calculated proceeding completion time becomes equal to or earlier than the proceeding completion target time, the estimating of the surrounding environment and the calculating of the proceeding completion time being performed, each time the proceeding start time is changed; and providing a control instruction to the movable body to proceed to the second position at the proceeding start time corresponding to the proceeding completion time that is equal to or earlier than the proceeding completion target time.

5. An operation management apparatus comprising:

a returning time setter configured to provisionally set a returning start time of a movable body on a basis of a proceeding start time of the movable body, a workable time period of the movable body, and an initial value of a time period necessary for returning of the movable body to a first position from a second position;

a surrounding environment estimating unit configured to estimate a surrounding environment at the returning start time of the movable body;

an energy calculator configured to search a returning route on a basis of the surrounding environment estimated by the surrounding environment estimating unit, and calculate an energy amount, the returning route being a route along which the movable body performs the returning, to the first position from the second position, that is started at the returning start time, the energy amount being an energy amount necessary for the returning, of the movable body, that is started at the returning start time;

a time changer configured to change the returning start time to be earlier by a predetermined time period until the energy amount necessary for the returning, calculated by the energy calculator, becomes equal to or smaller than an amount of fuel for the movable body, the surrounding environment estimating unit being configured to perform the estimation of the surrounding environment and the energy calculator being configured to perform the calculation of the energy amount, each time the time changer changes the returning start time; and a controller configured to provide a control instruction to the movable body to return to the first position at the returning start time corresponding to the energy amount that is equal to or smaller than the amount of fuel for the movable body.

6. An operation management apparatus comprising:

a proceeding time setter configured to provisionally sets a proceeding start time of a movable body on a basis of a proceeding completion target time of the movable body and an initial value of a time period necessary for proceeding of the movable body from a first position to a second position;

a surrounding environment estimating unit configured to estimate a surrounding environment at the proceeding start time of the movable body;

a time calculator configured to search a proceeding route on a basis of the surrounding environment estimated by the surrounding environment estimating unit, and calculate a proceeding completion time, the proceeding route being a route along which the movable body performs the proceeding, from the first position to the second position, that is started at the proceeding start time;

a time changer configured to change the proceeding start time to be earlier by a predetermined time period until the proceeding completion time calculated by the time calculator becomes equal to or earlier than the proceeding completion target time, the surrounding environment estimating unit being configured to perform the estimation of the surrounding environment and the time calculator being configured to perform the calculation of the proceeding completion time, each time the time changer changes the proceeding start time; and a controller configured to provide a control instruction to the movable body to proceed to the second position at the proceeding start time corresponding to the proceeding completion time that is equal to or earlier than the proceeding completion target time.

7. The operation management apparatus according to claim 5, wherein the time changer sets the returning start time of the movable body when the movable body has completed the proceeding from the first position to the second position.

8. The operation management apparatus according to claim 6, wherein the movable body comprises a plurality of movable bodies including a first movable body and a second movable body, the second movable body being different from the first movable body and a replacement for the first movable body, and when the first movable body has completed the proceeding from the first position to the second position, the time changer sets the proceeding start time of the second movable body.

9. The operation management apparatus according to claim 5, wherein the movable body comprises an unmanned aerial vehicle.

10. The operation management apparatus according to claim 7, wherein the movable body comprises an unmanned aerial vehicle.

11. The operation management apparatus according to claim 6, wherein the movable body comprises an unmanned aerial vehicle.

12. The operation management apparatus according to claim 8, wherein the movable body comprises an unmanned aerial vehicle.

13. An operation management apparatus comprising circuitry configured to provisionally set a returning start time of a movable body on a basis of a proceeding start time of the movable body, a workable time period of the movable body, and an initial value of a time period necessary for returning of the movable body to a first position from a second position, estimate a surrounding environment at the returning start time of the movable body, search a returning route on a basis of the estimated surrounding environment, and calculates an energy amount, the returning route being a route along which the movable body performs the returning, to the first position from the second position, that is started at the returning start time, the energy amount being an energy amount necessary for the returning, of the movable body, that is started at the returning start time, change the returning start time to be earlier by a predetermined time period until the calculated energy amount becomes equal to or smaller than an amount of fuel for the movable body, the estimation of the surrounding environment and the calculation of the energy amount being performed, each time the changing of the returning start time is performed; and provide a control instruction to the movable body to return to the first position at the returning start time corresponding to the energy amount that is equal to or smaller than the amount of fuel for the movable body.

14. An operation management apparatus comprising circuitry configured to provisionally set a proceeding start time of a movable body on a basis of a proceeding completion target time of the movable body and an initial value of a time period necessary for proceeding of the movable body from a first position to a second position, estimate a surrounding environment at the proceeding start time of the movable body, search a proceeding route on a basis of the estimated surrounding environment, and calculates a proceeding completion time, the proceeding route being a route along which the movable body performs the proceeding, from the first position to the second position, that is started at the proceeding start time, change the proceeding start time to be earlier by a predetermined time period until the calculated proceeding completion time becomes equal to or earlier than the proceeding completion target time, the estimation of the surrounding environment and the calculation of the proceeding completion time being performed, each time the changing of the proceeding start time is performed, and provide a control instruction to the movable body to proceed to the second position at the proceeding start time corresponding to the proceeding completion time that is equal to or earlier than the proceeding completion target time.

* * * * *